United States Patent [19]

Ellingson

[11] 4,262,950

[45] Apr. 21, 1981

[54] LATERAL SHIFTING DEVICE FOR CRANE

[75] Inventor: Robert M. Ellingson, Green Bay, Wis.

[73] Assignee: Paper Converting Machine Company, Green Bay, Wis.

[21] Appl. No.: 1,490

[22] Filed: Jan. 8, 1979

[51] Int. Cl.[3] ..... B66C 1/22

[52] U.S. Cl. ..... 294/67 AA; 414/715; 414/719

[58] Field of Search ..... 414/608, 640, 641, 642, 414/673, 719, 715; 294/67 AA, 81 R, 88; 212/48, 49

[56] References Cited

U.S. PATENT DOCUMENTS

| | | | |
|---|---|---|---|
| 3,734,326 | 5/1973 | Esser | 414/719 |
| 3,826,112 | 7/1974 | Sick | 294/67 AA X |

*Primary Examiner*—Robert G. Sheridan

*Attorney, Agent, or Firm*—Tilton, Fallon, Lungmus & Chestnut

[57] ABSTRACT

A device adapted to be suspended from a crane for lifting and laterally shifting a load including a frame having a fork lift attached thereto for carrying the load and a counterweight means to compensate for the weight of the load and to selectively position the fork lift in a tilted condition.

5 Claims, 6 Drawing Figures

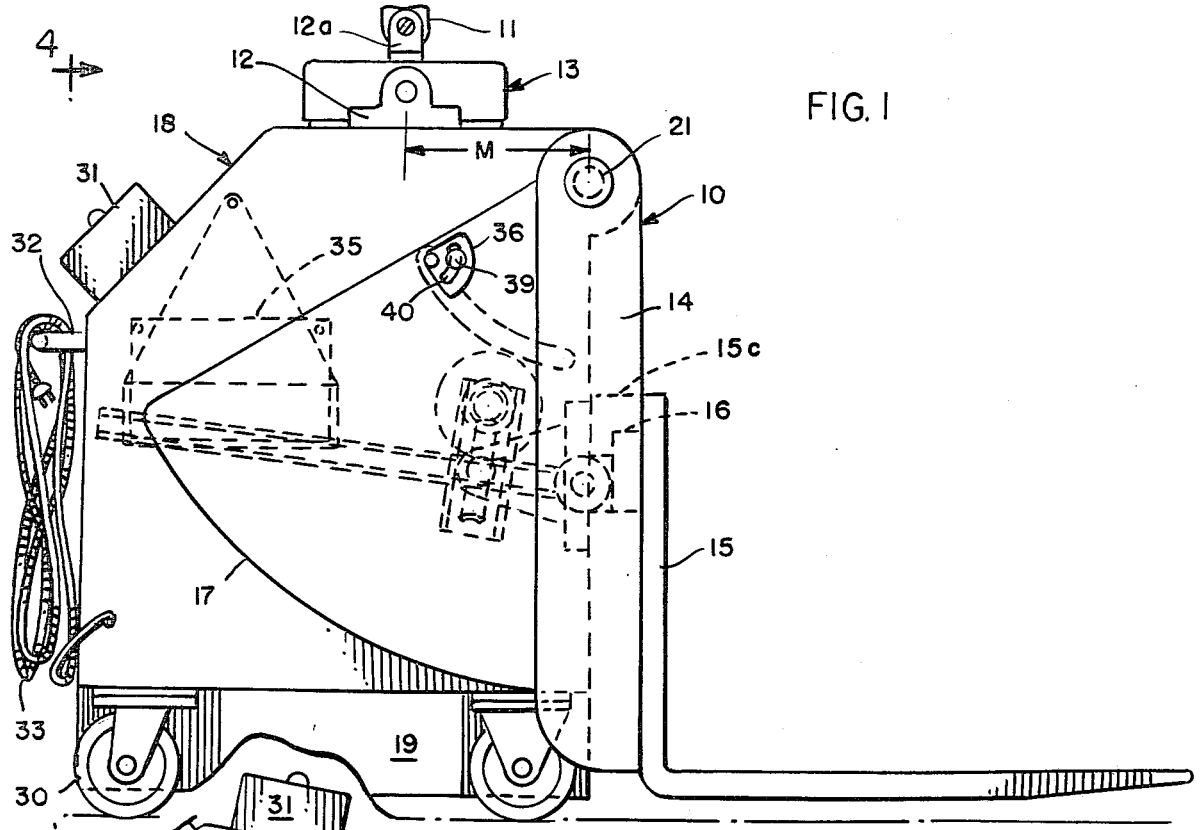
FIG. 1
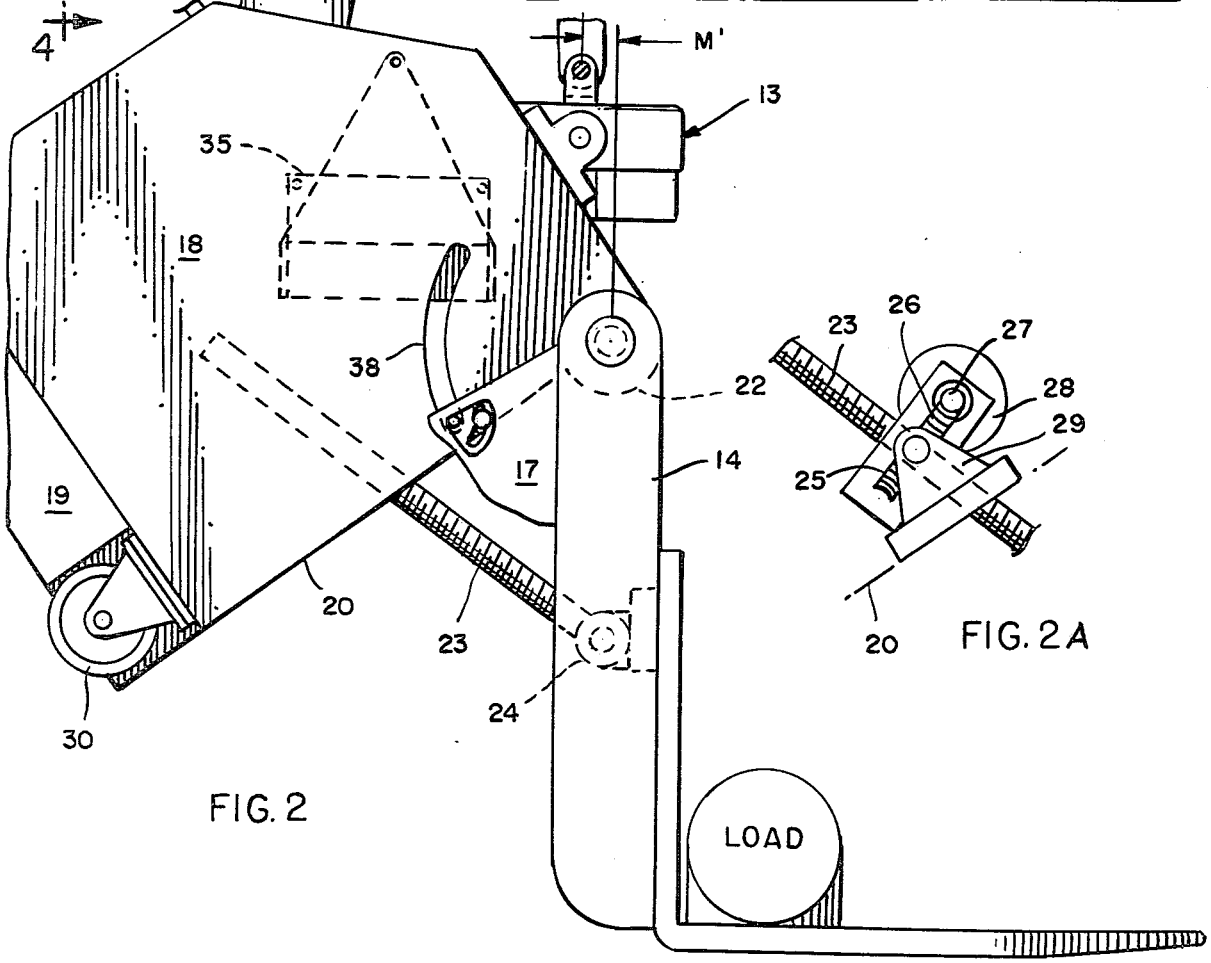
FIG. 2
FIG. 2A

FIG. 3
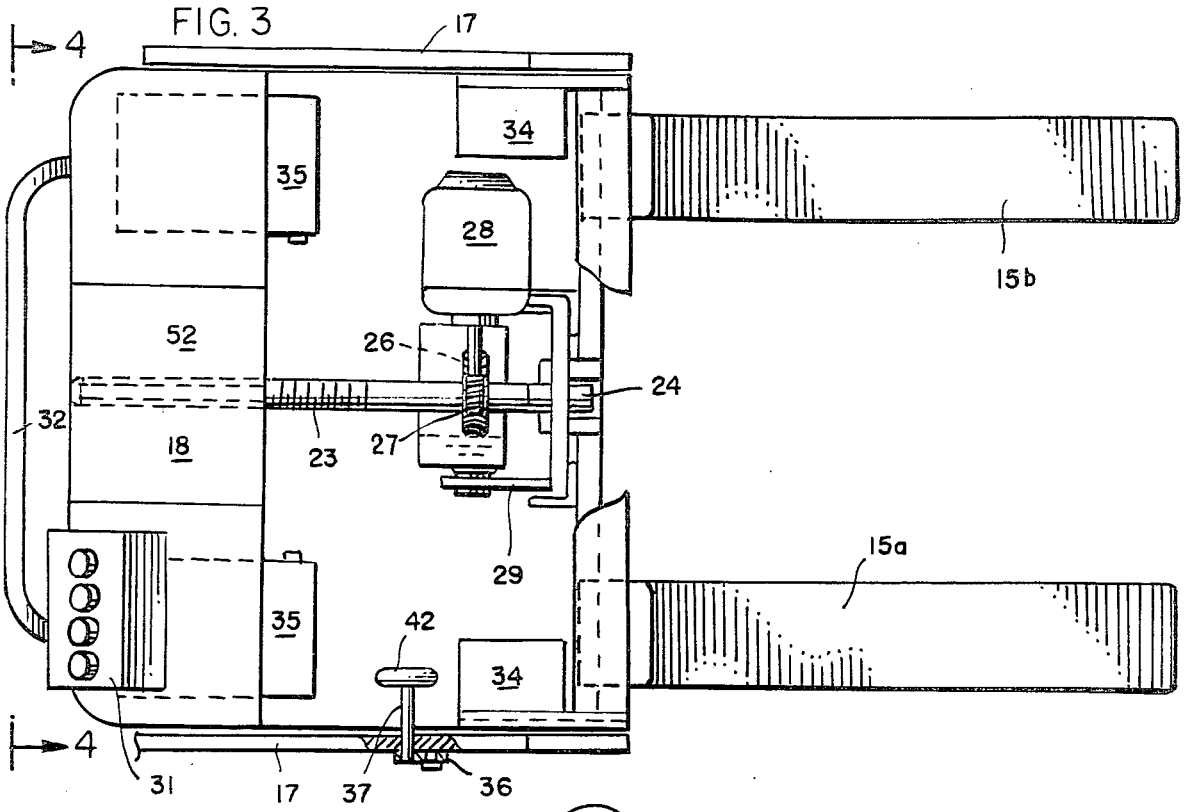
FIG. 4
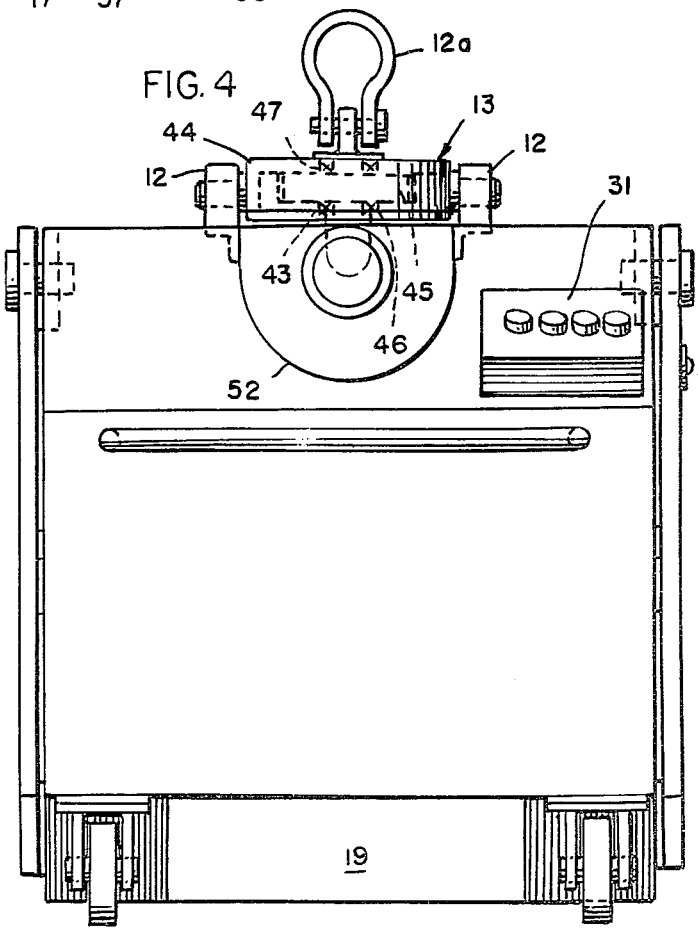
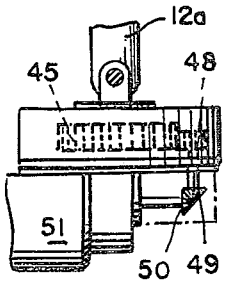
FIG. 5

LATERAL SHIFTING DEVICE FOR CRANE

BACKROUND OF THE INVENTION

The invention relates to devices employed for lifting and laterally shifting heavy and awkward loads such as calendar rolls which have to be lifted from the ground level of a building for storage on wall mounted racks. In the past, numerous devices have been used to perform the operation of lifting and shifting loads. A search of Classes 214 and 294 revealed:

Moore, U.S. Pat. No. 2,181,461
Moore, U.S. Pat. No. 2,246,142
Saether, U.S. Pat. No. 3,762,755
Moseley, U.S. Pat. No. 2,495,658
Durgan, U.S. Pat. No. 3,998,488
Belinsky, U.S. Pat. No. 4,017,109
Pim, U.S. Pat. No. 3,847,429
Canadian, Pat. No. 798,749

Many of these prior art teachings indicate that the idea of utilizing a counterweight with a crane for shifting heavy loads laterally is old. However, previous counterweight compensators have proved to be dangerous to both human life and property. Prior art devices were easily susceptible to hunting and cycling when an inexperienced crane operator is maneuvering the device. In addition, objects could easily slide or roll off when the lifting devices were in operation.

Other lifting devices can only handle a load with a predetermined size and weight requiring the weight of the counterweight to be changed according to the size and weight of the load. Those counterweight lifting devices that can easily handle varying sizes and weights of loads require more operating space in order to balance the load and the counterweight. As a result these devices are not easily operable in small areas.

SUMMARY OF THE INVENTION

It is the principal object of the invention to provide a new and improved counterweighted lifting device adapted to be suspended from a crane. More specifically, it is an object of the invention to provide a safe, reliable, and rugged counterweight shifting device wherein the compensating counterweight is movable in a vertical fashion via means provided on the frame of the device.

Another object of the present invention is to provide a lifting device which may be easily tilted to prevent objects from sliding or rolling off the device.

A further object of the present invention is to provide a device which does not require much additional space in order to operate.

Still another object of the present invention is to provide a device which is not easily susceptible to hunting and cycling.

Yet another object of the present invention is to provide a counterweight shifting device which may be easily controlled in operation without any danger to the operator.

DESCRIPTION OF THE DRAWINGS

FIG. 1 is a side view of the inventive device in the unloaded condition;

FIG. 2 is a side view of the invention with the counterweight support rotated upwardly to compensate for a load;

FIG. 2A is a fragmentary side view of certain interior components seen in dotted line in FIG. 1 but oriented as they would be in FIG. 2;

FIG. 3 is a top view of the invention in the position represented by FIG. 1 with upper portions removed for ease of understanding;

FIG. 4 is an end view of the invention as seen along the sight line 4-4 of FIG. 1; and FIG. 5 is a fragmentary side elevational view of the swivel mechanism of FIG. 4.

DESCRIPTION OF THE INVENTION

Referring first to FIG. 1, the numeral 10 designates generally a load compensating device adapted to be suspended from a crane 11 by means of a clevis 12 (see also FIG. 4). The numeral 13 in FIGS. 1 and 4 generally designate a positive swiveling mechanism to be described hereinafter. The mechanism 13 orients the device in a desired angular orientation relative to the crane.

The device 10 includes a frame 14 having a fork 15 mounted thereon. For this purpose, the frame 14 includes a transverse bar 16 over which the fork lift fingers 15*a* and 15*b* (see FIG. 3) are hooked as at 15*c* in FIG. 1.

Rigidly fixed to the frame 14 are a pair of quadrant shaped guards 17 (see also FIG. 3). Quadrant guards 17 are secured to the rear sides of the frame 14. Each guard projects in a direction generally parallel to the confronting side of the counterweight support generally designated 18 while occupying a planar area at an approximate 54° angle with respect to the top of the frame 14 (see FIG. 1). The quadrant guards 17 protect the user from getting caught between the support 18 and the frame 14. For ease of understanding, the rear guard 17 in FIG. 2 has been broken away.

In the illustration given, the counterweight support 18 not only carries the counterweight block 19—see the lower central part of FIG. 1—but also provides a housing or enclosure 20 (not so designated in FIGS. 2 and 2A) for the prime mover and controls. The counterweight support 18 is pivotally supported on the frame 14 or shaft 21 (see the upper right hand portion of FIG. 1). For this purpose the enclosure is equipped with lugs 22 which are pivotally mounted on the cross shaft 21. As can be appreciated from a comparison of FIGS. 1 and 2, the counterweight support 18 is swung clockwise by virtue of the swing means 23 which, in the illustration given is a compensating screw mechanism.

More particularly, the screw 23 is pivotally connected to the frame 14 at one end as at 24 (see FIG. 2) and is threadedly received within a traveling nut device 25 (see FIG. 2A) which is mounted within the enclosure 20. The nut is carried axially of a worm gear 26 (see also FIG. 3) which is driven by means of a worm 27 fixed to the output shaft of the motor 28.

Inasmuch as the angular relationship between the worm gear 26 (viz., the nut portion thereof) and the screw 23 changes during swinging of the counterweight support 18, the nut mechanism 25 and motor 28 are pivotally mounted on trunnion pedestals 29 carried interiorly of the enclosure 20 and fixed therein. It should be noted that a significant advantage of the invention resulting from the rotary movement of the counterweight support 18 is that the load is brought closer to the crane, i.e., compare the moment arm M of FIG. 1 with moment arm M' of FIG. 2. So the load is not only balanced but stabilized at the same time.

When the device 10 is in the unloaded position—as in FIG. 1, casters 30 uphold the counterweight support 18 on the floor. The counterweight 19 attaches to the bottom wall of the support 18 between the four casters 30 so that the shape of the counterweight 19 is that of the shape of a cross (not shown).

A control panel 31 containing four push buttons is mounted on the slanted, upper rear portion of the counterweight support 18. Two of the buttons regulate the upwards and downward rotation of the counterweight support. While the other two control the right and left rotational aspect of the device 10 via the mechanism 13, a handle 32 is mounted across the back of the support 18 for manually positioning the device on the floor. An electric cord 33 (see FIG. 3) is connected to the relay boxes 34 and batteries 35 inside the chamber 15*a* of the support 18. The cord 33 hangs on the handle 32 when it is not used. If the control panel 31 is detached from the support 18 for use at a distance away from the device, the cord 32 is plugged into the control panel 31. It will also be noted that the batteries 35 are swingably mounted within the enclosure 20 (compare FIGS. 1 and 2) so that change in attitude of the support 18 does not affect the acid level.

OPERATION OF THE INVENTION

When a load is ready to be moved, the user positions the fork 15 under the load and subsequently presses the up button until the fork 15 slants upwardly by virtue of the nut mechanism 25 traveling along the screw 23. Other extensible shift means such as fluid pressure cylinder and piston rod units may be employed. The clevis 12*a* is then coupled to the hook 11 of a crane. Thereafter, the crane lifts the device 10 and the load off the floor while the user presses the up button as necessary to keep the load level. The up button is pressed until the fork 15 slants upwardly as much as is required for safe operation. It will be appreciated that a radio controlled relay switch can be supplied to balance the load from a remote station.

The crane moves the loaded device 10 to a rack for unloading. If the front of the fork 15 is not properly aligned with the rack, the user presses the right or left turn buttons as required, until the lifting device 10 is in the proper unloading position. Then the load is placed on the rack and the down button is pressed until the fork 15 slants downwardly for unloading. Subsequently, the crane removes the device 10 from the rack area, and the up button is pressed until the fork 15 is level. The compensating device is then ready for another load.

A quadrant 36 is provided on one of the guards 17 to limit maximum tilt. For this purpose the guadrant is secured (see FIG. 3) extending through an arcuate slot 38 (see FIG. 2) in the guadrant 17. It is secured by screw 39 in its slot 40. The rod 37 extends through the arcuate slot 38 into the interior of the support 18. A mercury switch 42 (see FIG. 3) is attached to the inside end of the rod 37. The level of the switch 42 determines the maximum angle of tilt forward permitted by the fork lift 15. The position of the quadrant 36 controls the level of the mercury switch 42. Therefore, the user may adjust the maximum angle of tilt forward by loosening screw 39, rotating quadrant 36 to the preferred position, and then retightening screw 39 in the arcuate slot 40.

The clevis 12*a* as shown in FIG. 4, pivots above the counterweight support 18 on a gear shaft 43. The gear shaft 43 extends into a gear housing 44 which is pivotally mounted by clevis elements 12 to the top of the counterweight support 18. The gear shaft is coupled to gear 45 which is supported by bearings 46 and 47. Gear 45 is driven by a spur gear 48 from motor gears 49 and 50 from the motor 51, as shown in FIG. 5. Thus, the attitude of the device 10 relative to a vertical axis can be positively controlled. The counterweight support 18 is recessed as at 52 (see FIG. 3) to accommodate tilting thereof without interfering with the device 13.

While in the foregoing specification a detailed description of the best mode known for practicing the invention has been set forth, many variations in the details hereingiven may be made by those skilled in the art without departing from the spirit and scope of the invention.

I claim:

1. A device adapted to be suspended from a crane for lifting and laterally shifting a load comprising a frame having a fork attached thereto and a vertically moveable counterweight support mounted thereon, and means operably associated with said counterweight support to compensate for the weight of said load and to position said fork in a tilted condition while decreasing the moment arm between the crane and frame, a quadrant guard secured to each side of said frame and projects in a direction generally parallel to the confronting side of said counterweight support, each guard occupying a planar area at an approximate 54° angle with respect to the top of said frame, said counterweight support being equipped with an adjustable switch means for preventing the angle of tilt forward of said fork means from exceeding a predetermined number of degrees.

2. The device of claim 1 in which said switch means includes a rod extending from the outer wall of one guadrant guard and through an opening in the adjacent wall of said counterweight support and having a mercury switch inside said counterweight support attached to one end thereof and an adjustable quadrant mounted at the other end thereof.

3. The device of claim 2 in which said support opening is arcuate.

4. A device adapted to be suspended from a crane for lifting and laterally shifting a load comprising a frame having a fork attached thereto and a vertically moveable counterweight support mounted thereon, and means operably associated with said counterweight support to shift the same relative to said frame in order to compensate for the weight of said load and to position said fork in a tilted condition while decreasing the moment arm between the crane and frame, means being provided for connecting said device to a crane and horizontally rotating said device with respect to said crane, said connecting means being pivotally mounted on the top of said counterweight support.

5. The device of claim 4 in which said support is equipped with a recess for accomodating vertical swinging of said support without interferring with said connecting means.

* * * * *